US009460659B2

(12) United States Patent
Jeong

(10) Patent No.: US 9,460,659 B2
(45) Date of Patent: Oct. 4, 2016

(54) FLEXIBLE DISPLAY APPARATUS AND METHOD OF REPAIRING THE SAME

(71) Applicant: SAMSUNG DISPLAY CO., LTD., Yongin, Gyeonggi-Do (KR)

(72) Inventor: Jin-Tae Jeong, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 76 days.

(21) Appl. No.: 14/336,941

(22) Filed: Jul. 21, 2014

(65) Prior Publication Data

US 2015/0243214 A1 Aug. 27, 2015

(30) Foreign Application Priority Data

Feb. 25, 2014 (KR) ..... 10-2014-0022183

(51) Int. Cl.
*G09G 3/3233* (2016.01)
*G09G 3/32* (2016.01)

(52) U.S. Cl.
CPC .... *G09G 3/3233* (2013.01); *G09G 2300/0413* (2013.01); *G09G 2300/0809* (2013.01); *G09G 2320/0233* (2013.01); *G09G 2320/046* (2013.01)

(58) Field of Classification Search
CPC ..... G09G 3/3233; G09G 3/32; G09G 2300/0413
See application file for complete search history.

(56) References Cited

U.S. PATENT DOCUMENTS

| | | | | |
|---|---|---|---|---|
| 6,327,007 | B1 | 12/2001 | Shim | |
| 2010/0141693 | A1* | 6/2010 | Lee | G09G 3/3216 345/694 |
| 2010/0207106 | A1 | 8/2010 | Lhee et al. | |
| 2010/0244069 | A1* | 9/2010 | Weaver | G09G 3/3208 257/98 |
| 2012/0202400 | A1 | 8/2012 | Takagi et al. | |
| 2014/0347401 | A1* | 11/2014 | Hwang | G09G 3/3233 345/690 |

FOREIGN PATENT DOCUMENTS

| | | | |
|---|---|---|---|
| JP | 2007-316511 | A | 12/2007 |
| KR | 10-0305322 | B1 | 11/2001 |
| KR | 10-2010-0093220 | A | 8/2010 |
| KR | 10-2011-0023028 | A | 8/2011 |

* cited by examiner

*Primary Examiner* — Alexander Eisen
*Assistant Examiner* — Cory Almeida
(74) *Attorney, Agent, or Firm* — Lewis Roca Rothgerber Christie LLP

(57) ABSTRACT

A flexible display apparatus includes: a light-emitting pixel including a driving unit configured to output a driving current corresponding to a data signal and a light-emitting device configured to emit light according to the driving current; a repair line connectable to the light-emitting pixel; a first control line extending in a first direction and a second control line extending in a second direction; a switching unit that is coupled to the first control line and the second control line and configured to control a connection between the repair line and the light-emitting pixel according to at least one of a first control signal applied through the first control line or a second control signal applied through the second control line; and a dummy pixel coupled to the repair line, and coupled to the light-emitting pixel via the switching unit.

20 Claims, 9 Drawing Sheets

FLEXIBLE DISPLAY APPARATUS AND METHOD OF REPAIRING THE SAME

CROSS-REFERENCE TO RELATED APPLICATION

This application claims priority to and the benefit of Korean Patent Application No. 10-2014-0022183, filed on Feb. 25, 2014, in the Korean Intellectual Property Office, the disclosure of which is incorporated herein in its entirety by reference.

BACKGROUND

1. Field

One or more embodiments of the present invention relate to a flexible display apparatus and a method of repairing the same.

2. Description of the Related Art

When a defect is generated in a pixel, light may be constantly emitted from the pixel regardless of the presence of a scanning signal or a data signal, or the pixel may be displayed in black. A pixel that constantly emits light is recognized by an observer as a bright spot, and a pixel that is displayed in black is recognized by an observer as a dark spot.

As circuits in a pixel become complicated, it is difficult to overcome bright spots or black spots due to circuit defects.

SUMMARY

One or more embodiments of the present invention include a flexible display apparatus for which defective pixels may be repaired without directly irradiating laser to a display area of the flexible display apparatus but by using a dummy pixel.

Additional aspects will be set forth in part in the description which follows and, in part, will be apparent from the description, or may be learned by practice of the presented embodiments.

According to one or more embodiments of the present invention, a flexible display apparatus includes: a light-emitting pixel including a driving unit configured to output a driving current corresponding to a data signal and a light-emitting device configured to emit light according to the driving current; a repair line connectable to the light-emitting pixel; a first control line extending in a first direction and a second control line extending in a second direction; a switching unit that is coupled to the first control line and the second control line and configured to control a connection between the repair line and the light-emitting pixel according to at least one of a first control signal applied through the first control line or a second control signal applied through the second control line; and a dummy pixel coupled to the repair line, and coupled to the light-emitting pixel via the switching unit.

The switching unit may include: a first repair switching device coupled to the light-emitting pixel, and configured to be turned on or off by the first control signal; and a second repair switching device serially coupled to the first repair switching device, and coupled to the repair line, and configured to be turned on or off by the second control signal.

The first repair switching device may be coupled to the light-emitting device of the light-emitting pixel.

The flexible display apparatus may include: a first control voltage line outside of a display area of the flexible display apparatus, and coupled to the first and second control lines; and a second control voltage line separate from the first control voltage line, and connectable to the first and second control lines.

The first control voltage line may be configured to apply the first control signal to the first control line and the second control line, and the switching unit may be configured to block an electrical connection between the repair line and the light-emitting pixel via the first control signal.

Outside of the display area, the first control voltage line may be separated from the first control line and the second control line, and the second control voltage line may be coupled to the first control line and the second control line.

The second control voltage line may be configured to apply the second control signal to the first control line and the second control line, and the switching unit may be configured to couple the repair line and the light-emitting pixel via the second control signal.

The first repair switching device and the second repair switching device may include thin film transistors.

The flexible display apparatus may further include: a data driver configured to apply the data signal to a data line; a scanning driver configured to apply a scanning signal to a scanning line; and a power supply unit configured to generate a first driving voltage and a second driving voltage, the second driving voltage being lower than the first driving voltage, the power supply unit being further configured to apply the first and second driving voltages to the data driver and the scanning driver, wherein the control signal is the first driving voltage or the second driving voltage.

The flexible display apparatus may further include: a flexible substrate on which the light-emitting pixel and the dummy pixel are located; and an encapsulation thin film covering the light-emitting pixel and the dummy pixel.

According to one or more embodiments of the present invention, a flexible display apparatus may include: a plurality of light-emitting pixels in a display area; a plurality of dummy pixels located around the display area; a plurality of repair lines coupled to the plurality of dummy pixels and connectable to the plurality of light-emitting pixels; a plurality of first control lines configured to apply a first control signal and a plurality of second control lines configured to apply a second control signal; and a plurality of switching units, each coupled to a corresponding first control line from among the plurality of first control lines, a corresponding second control line from among the plurality of second control lines, and a corresponding light-emitting pixel from among the plurality of light-emitting pixels.

Each of the plurality of switching units may include: a first repair switching device coupled to the corresponding light-emitting pixel and configured to be turned on or off by a control signal received from the corresponding first control line; and a second repair switching device serially coupled to the first repair switching device, and coupled to a corresponding repair line from among the plurality of repair lines, and configured to be turned on or off by the second control signal received from the corresponding second control line.

The first repair switching device may be coupled to a light-emitting device of the corresponding light-emitting pixel from among the plurality of light-emitting pixels.

The flexible display apparatus may further include: a first control voltage line located outside of the display area and coupled to the plurality of first and second control lines; and a second control voltage line separate from the first control voltage line and located outside of the display area and connectable to the first and second control lines.

The first control voltage line may be configured to apply a first control signal to the first control line and the second control line, and each of the plurality of switching units is configured to block a connection between a corresponding repair line from among the plurality of repair lines and the corresponding light-emitting pixel.

Outside of the display area, at least one of the plurality of first control lines and at least one of the plurality of second control lines are separated from the first control voltage line and coupled to the second Control voltage line.

The second control voltage line may be configured to apply a second control signal to the first control line and the second control line, and a switching unit from among the plurality of switching units which is coupled to the first control line and the second control line, through which the second control signal is applied, the switching unit configured to couple a corresponding repair line from among the plurality of repair lines and the corresponding light-emitting pixel.

According to one or more embodiments of the present invention, a method of repairing a flexible display apparatus including a plurality of light-emitting pixels and a plurality of dummy pixels, a plurality of repair lines coupled to the plurality of dummy pixels, a plurality of first control lines and a plurality of second control lines coupled to a first control voltage line arranged outside of a display area, and a plurality of switching units coupled to the plurality of first control lines and the plurality of second control lines, may include: detecting a defective pixel from among the plurality of light-emitting pixels; separating a first control line of the plurality of first control lines and a second control line of the plurality of second control lines coupled to a switching unit corresponding to the defective pixel, from the first control voltage line, at the outside of the display area; and electrically coupling the first control line and the second control line separated from the first control voltage line, to a second control voltage line separate from the first control voltage line, at the outside of the display area.

The plurality of switching units may include: a first repair switching device coupled to one of the plurality of light-emitting pixels and one of the plurality of first control lines; and a second repair switching device coupled to one of the plurality of repair lines and one of the plurality of second control lines.

The switching unit of the defective pixel may receive a second control signal from the second control voltage line through the first control line and the second control line to couple the defective pixel to a dummy pixel via a repair line of the plurality of repair lines, and wherein each of the plurality of switching units of the light-emitting pixels other than the defective pixel receives a first control signal from the first control voltage line through the first control lines and the second control lines to block connection between a corresponding light-emitting pixel from among the plurality of light-emitting pixels and the repair line.

BRIEF DESCRIPTION OF THE DRAWINGS

These and/or other aspects will become apparent and more readily appreciated from the following description of the embodiments, taken in conjunction with the accompanying drawings in which.

DETAILED DESCRIPTION

Figure 1:
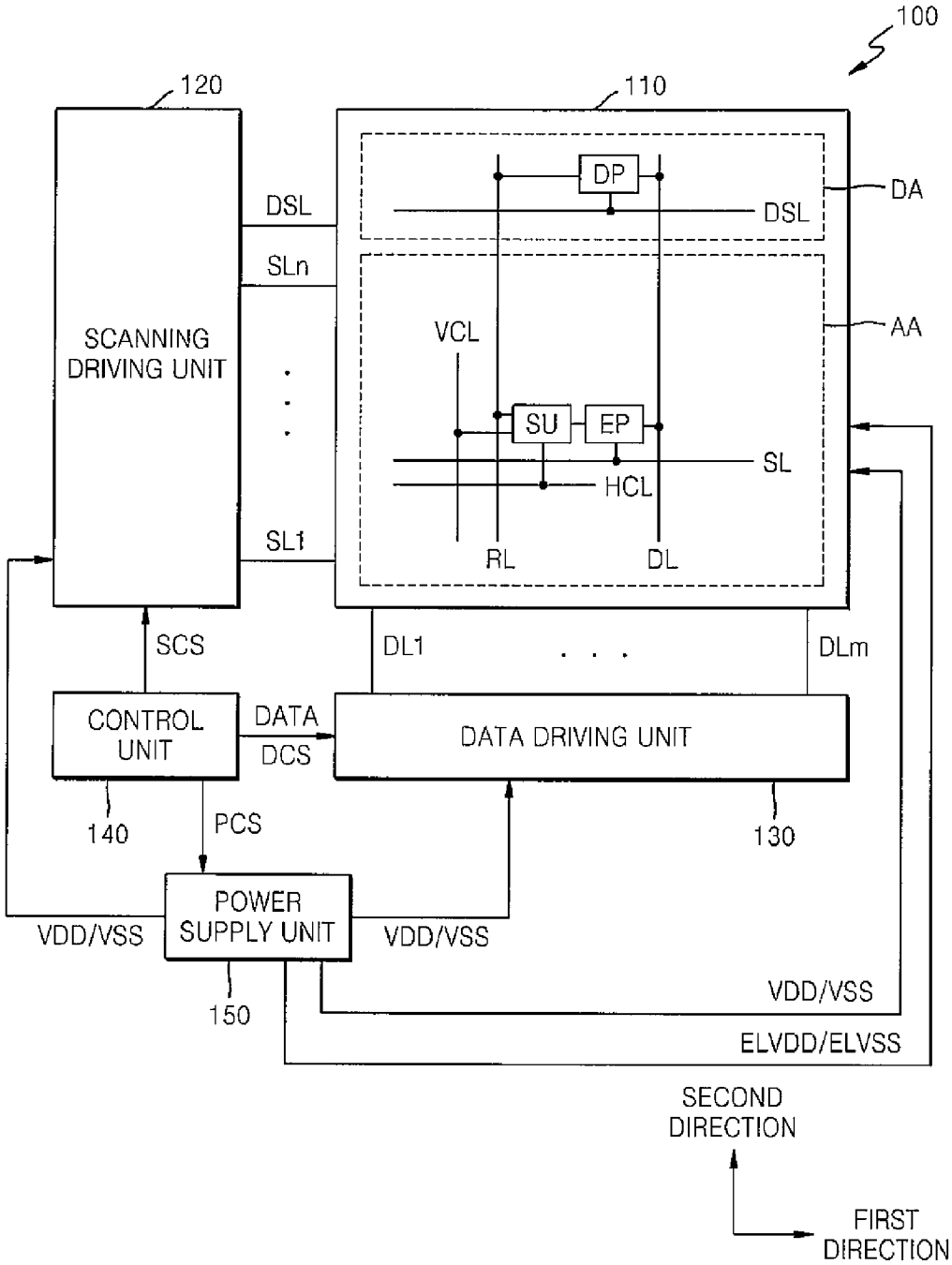
FIG. 1 is a block diagram of a flexible display apparatus according to an embodiment of the present invention.

Reference will now be made in more detail to embodiments, examples of which are illustrated in the accompanying drawings, wherein like reference numerals refer to like elements throughout. In this regard, the embodiments may have different forms and should not be construed as being limited to the descriptions set forth herein. Accordingly, the embodiments are merely described below, by referring to the figures, to explain aspects of the present description. As used herein, the term "and/or" includes any and all combinations of one or more of the associated listed items. Expressions such as "at least one of," when preceding a list of elements, modify the entire list of elements and do not modify the individual elements of the list.

Because the present invention may have various modifications and several embodiments, example embodiments are shown in the drawings and will be described in detail. Effects, features, and a method of achieving the same will be specified with reference to the embodiments described below in detail together with the attached drawings. However, the embodiments may have different forms and should not be construed as being limited to the descriptions set forth herein.

The embodiments of the present invention will be described below in more detail with reference to the accompanying drawings. Those components that are the same or are in correspondence are rendered the same reference numeral regardless of the figure number, and redundant explanations are omitted.

It will be understood that although the terms "first", "second", etc. may be used herein to describe various components, these components should not be limited by these terms. These components are only used to distinguish one component from another. Also, singular expressions, unless defined otherwise in contexts, include plural expressions.

In the embodiments below, it will be further understood that the terms "comprise" and/or "have" used herein specify the presence of stated features or components, but do not preclude the presence or addition of one or more other features or components. Also, when an element is referred to as being "coupled to" or "coupled with" another element, the elements may be directly coupled or indirectly coupled (e.g., electrically or remotely coupled with one or more elements therebetween).

FIG. 1 is a block diagram of a flexible display apparatus 100 according to an embodiment of the present invention.

Referring to FIG. 1, the flexible display apparatus 100 may include a display panel 110, a scanning driving unit (or a scan driver) 120, a data driving unit (or a data driver) 130, a control unit (or a controller) 140, and a power supply unit 150. The scanning driving unit 120, the data driving unit 130, and the control unit 140 may each be integrated on a separate integrated circuit (IC) chip or on a single IC chip and may be directly mounted on the display panel 110, may be mounted on a flexible printed circuit film, may be attached to the display panel 110 in the form of a tape carrier package (TCP), may be mounted on an additional printed circuit board, or may be formed on the same substrate as the display panel 110.

The display panel 110 may include a display area AA where an image signal is displayed and a dummy area DA which is a portion of a non-display area around the display area AA. The dummy area DA may be located at least above or below (e.g., at one or both the opposite sides with respect to) the display area AA.

In the display area AA, a plurality of light-emitting pixels EP that are coupled to a plurality of scanning lines SL1 through SLn and a plurality of data lines DL1 through Dm are arranged. In the dummy area DA, a plurality of dummy pixels DP that are coupled to a dummy scanning line DSL and the plurality of data lines DL1 through DLm are arranged. The plurality of scanning lines SL1 through SLn may extend in a first direction, and the plurality of data lines DL1 through DLm may extend in a second direction. At least one dummy pixel DP may be included in each column in the first direction.

The display panel 110 may include a plurality of repair lines RL1 through RLm. A repair line RL may be parallel to the plurality of data lines DL1 through DLm. The repair line RL may be coupled to a dummy pixel DP of the same column, which is connectable to a light-emitting pixel EP of the same column. The term "connectable" refers that although predetermined lines are not electrically coupled, they are configured to be electrically coupled (e.g., connectable) through a connection member during a repair process. According to an embodiment of the present invention, a light-emitting pixel EP and a repair line RL, that is, the light-emitting pixel EP and the dummy pixel DP may be electrically coupled via a switching unit SU which will be described later. The repair line RL may be arranged in units of unit pixels or in units of a plurality of sub-pixels that constitute a unit pixel.

Also, in the display panel 110, a horizontal control line HCL may be arranged in the first direction, and a vertical control line VCL may be arranged in the second direction. The horizontal control line HCL and the vertical control line VCL may extend up to the non-display area, and may be coupled to a first control voltage line or a second control voltage line arranged in the non-display area. A switching unit SU couple to a light-emitting device of the light-emitting pixel EP may be arranged in an area where the horizontal control line HCL and the vertical control line VCL cross each other.

The switching unit SU may be coupled to a corresponding light-emitting pixel EP, that is, a light-emitting pixel EP arranged in the same column and the same row as the switching unit SU, and a corresponding repair line RL, that is, a repair line RL arranged in the same column as the switching unit SU. Also, the switching unit SU may be coupled to a corresponding horizontal control line HCL, that is, a horizontal control line HCL arranged in the same row as the switching unit SU, and a corresponding vertical control line VCL, that is, a vertical control line HCL arranged in the same column as the switching unit SU. The switching unit SU may receive a control signal through the horizontal control line HCL and the vertical control line VCL to electrically block the light-emitting pixel EP and the repair line RL or electrically couple the light-emitting pixel EP and the repair line RL according to the control signal. The control signal applied to the horizontal control line HCL and the vertical control line VCL may be a first driving voltage VDD or a second driving voltage VSS supplied by the power supply unit 150.

The switching unit SU may include a plurality of repair switching devices, and each repair switching device may include a thin film transistor (TFT). The switching unit SU may keep (or maintain) the repair line RL and the light-emitting pixel EP in an electrically blocked state; if the light-emitting pixel EP is a defective pixel, the switching unit SU may electrically couple the defective pixel to the repair line RL, thereby electrically coupling the defective pixel and a dummy pixel DP via the repair line RL.

The repair line RL may couple the defective pixel to the dummy pixel DP via the switching unit SU and provide a path through which a driving current generated by using the dummy pixel DP according to a data signal applied to the dummy pixel DP is transmitted to the defective pixel.

Also, a first power voltage line having a mesh structure arranged in the first and second directions may be arranged in the display panel 110. The light-emitting pixel EP and the dummy pixel DP may receive a first power voltage ELVDD from the power supply unit 150 via the first power voltage line.

The scanning driving unit 120 may receive a first driving voltage VDD and a second driving voltage VSS to generate a scanning signal, and may sequentially supply the scanning signal to the light-emitting pixel EP and the dummy pixel DP via the plurality of scanning lines SL1 through SLn and the dummy scanning line DSL, respectively. The dummy scanning line DSL may be a previous scanning line SL0 to a first scanning line SL1 or a next scanning line SLn+1 to a last scanning line SLn. Accordingly, the dummy pixel DP may receive a previous scanning signal to a first scanning signal or a next scanning signal to a last scanning signal of the display area AA.

The data driving unit 130 may receive a first driving voltage VDD and a second driving voltage VSS to convert input image data DATA that has a gray level and is input by the control unit 140, into a data signal in the form of a voltage or a current. The data driving unit 130 may supply a data signal to the light-emitting pixel EP and the dummy pixel DP through the plurality of data lines DL1 through DLm.

A data signal applied to the dummy pixel DP may be an arbitrarily set data signal. For example, the data signal may be a signal corresponding to black or white or an average of all data signals. When the dummy pixel DP is coupled to a defective pixel via the repair line RL, a data signal applied to the dummy pixel DP may be a data signal that is applied to, or is to be applied to a defective pixel coupled to the repair line RL.

The control unit 140 generates a scanning control signal SCS and a data control signal DCS, and transmits these to the scanning driving unit 120 and the data driving unit 130, respectively. Accordingly, the scanning driving unit 120 may sequentially apply scanning signals to the scanning lines SL1 through SLn and the dummy scanning line DSL, and the data driving unit 130 applies data signals to the data lines DL1 through DLm in response to the scanning signals.

The power supply unit 150 receives power from the outside and/or the inside to convert the power into voltages at various levels for the operation of elements of the flexible display apparatus 100, and supplies corresponding voltages to the scanning driving unit 120, the data driving unit 130, and the display panel 110 according to a power control signal PCS that is input by the control unit 140. The power supply unit 150 may include a direct current (DC)-DC converter.

The power supply unit 150 supplies a first driving voltage VDD and a second driving voltage VSS to the scanning driving unit 120, the data driving unit 130, and the display panel 110, and may supply a first power voltage ELVDD and a second power voltage ELVSS to the display panel 110. The first driving voltage VDD and the first power voltage ELVDD may be a predetermined high level voltage, and the first driving voltage VDD may be higher than the first power voltage ELVDD. The second power voltage ELVSS and the second driving voltage VSS may be lower than the first driving voltage VDD and the first power voltage ELVDD, respectively, and may be a ground voltage.

In some embodiments, a light emission control signal EM, an initialization voltage Vint, or the like, controlled by the control unit 140, may be applied to the light-emitting pixel EP and the dummy pixel DP.

While the dummy area DA is illustrated as being above the display area AA in FIG. 1, the present invention is not limited thereto, and the dummy area DA may be located at least above or below the display area AA or at least on the left or the right of the display area AA. When the dummy area DA is located at least on the left or the right of the display area AA, the dummy pixel DP may be included in each row in the second direction and the repair line RL may be coupled to the dummy pixel DP of the same row as the repair line RL and may be connectable to the light-emitting pixel EP of the same row as the repair line RL. In this case, the switching unit SU may be coupled to the repair line RL of the same row as the switching unit SU and to the light-emitting pixel EP of the same row and the same column as the switching unit SU.

Figure 2:
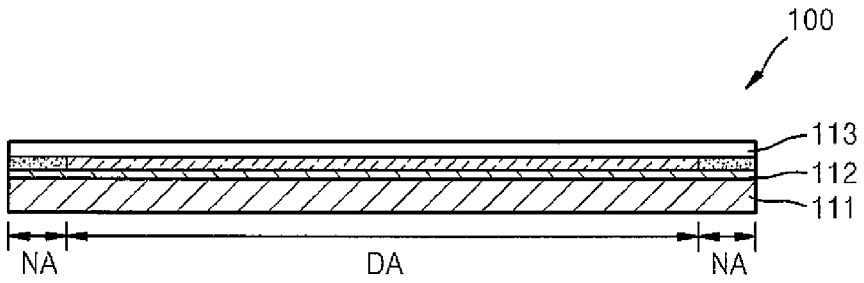
FIG. 2 is a cross-sectional view of a flexible display apparatus according to an embodiment of the present invention.
Figure 3:
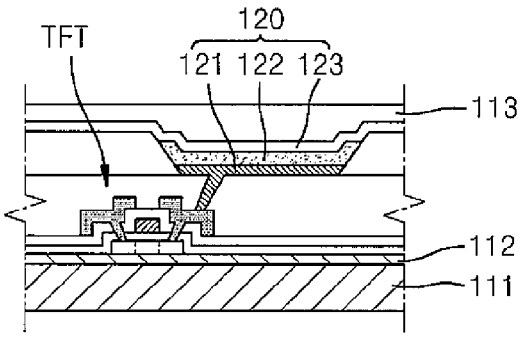
FIG. 3 is a cross-sectional view of a display area of FIG. 2 according to an embodiment of the present invention.

FIG. 2 is a cross-sectional view of the flexible display apparatus 100 according to an embodiment of the present invention. FIG. 3 is a cross-sectional view of a display area AA of FIG. 2 according to an embodiment of the present invention.

Referring to FIGS. 2 and 3, the flexible display apparatus 100 may include a flexible substrate 111, a barrier layer 112 on the flexible substrate 111, the display area AA and a non-display area NA located on the barrier layer 112 and an encapsulation member 113.

The flexible substrate 111 may be formed of a plastic material having relatively good heat resistance and relatively good durability, such as polyethylene terephthalate, polyethylene naphthalate, polycarbonate, polyarylate, polyetherimide, polyethersulfone, and polyimide. However, the material of the flexible substrate 111 is not limited thereto, and the flexible substrate 111 may be formed of various flexible materials.

The barrier layer 112 may be formed as at least one of an inorganic layer or an organic layer. The barrier layer 112 may prevent an undesired component from permeating through the flexible substrate 111 and penetrating into the display area AA.

A plurality of light-emitting pixels EP may be arranged in the display area AA, and dummy pixels DP may be arranged in the dummy area DA of the non-display area NA.

The light-emitting pixel EP includes a light-emitting device 120 including a pixel electrode 121, an opposite electrode 123, and an organic emission layer 122 interposed therebetween. The pixel electrode 121 may be electrically coupled to a pixel circuit that includes at least one TFT formed on the flexible substrate 111.

The encapsulation member 113 may be formed as an encapsulation thin film. The encapsulation thin film may be formed of a plurality of inorganic layers or may have a structure arrangement in which at least one inorganic layer and at least one organic layer are combined (e.g., stacked together).

In order to couple a defective pixel to a repair line RL, a shorting process (e.g., short circuiting process) is performed between wirings (for example, a repair line and an anode electrode of a light-emitting device) that are arranged with an insulation layer interposed therebetween, by performing laser irradiation from a side of the encapsulation member 113 or from a side of the flexible substrate 111. When performing laser irradiation from a side of the encapsulation member 113, the encapsulation member 113 and the light-emitting device below the encapsulation member 113 may be damaged. Also, the transmittivity of the flexible substrate 111 with respect to laser irradiation is relatively low.

According to an embodiment of the present invention, laser is not directly irradiated to the display area AA but a defective pixel of the display area AA and the dummy pixel DP are coupled to a repair line to perform a repair operation.

Figure 4:
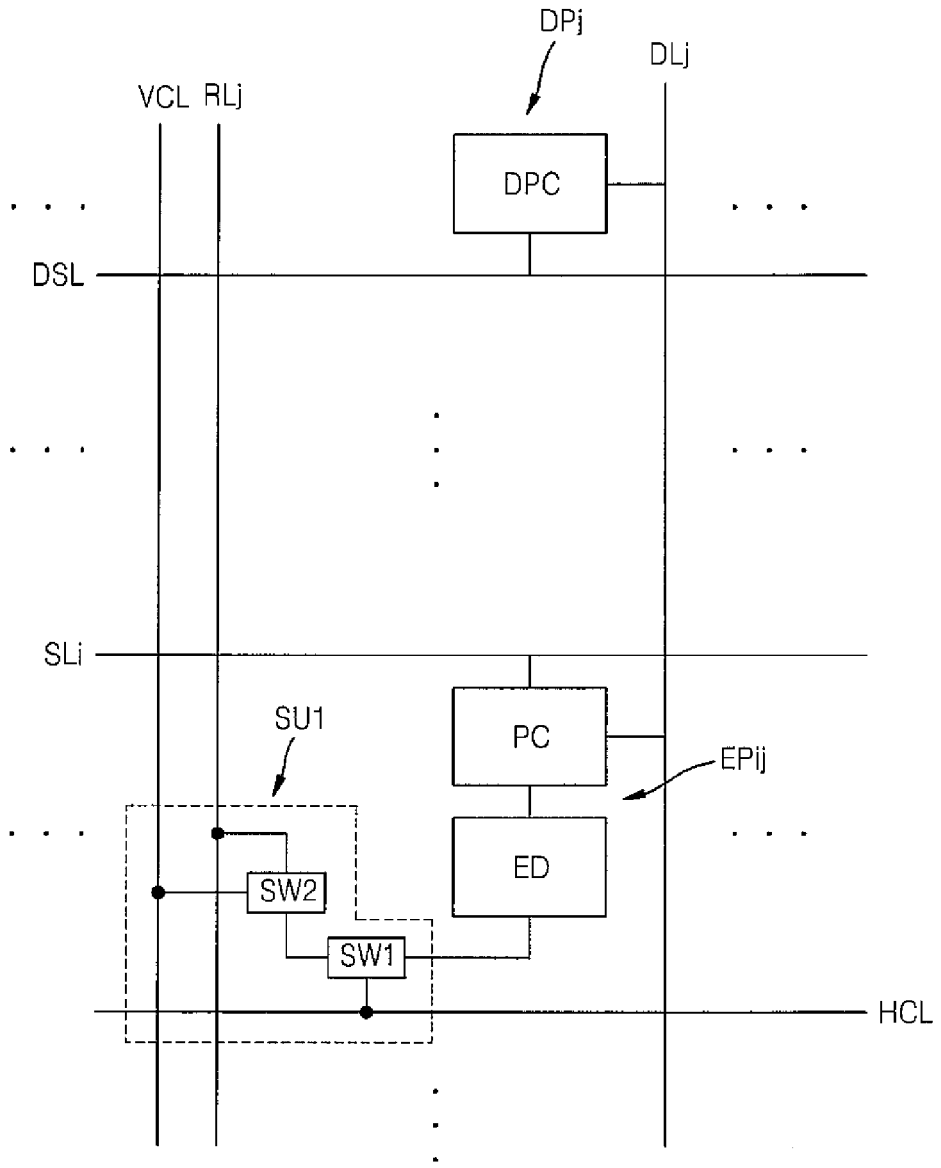
FIG. 4 is a plan view illustrating a portion of a display panel according to an embodiment of the present invention.
Figure 5:
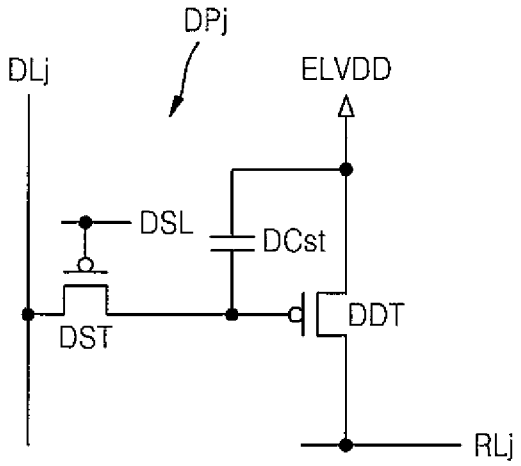
FIG. 5 is a circuit diagram of a dummy pixel of FIG. 4 according to an embodiment of the present invention.
Figure 6:
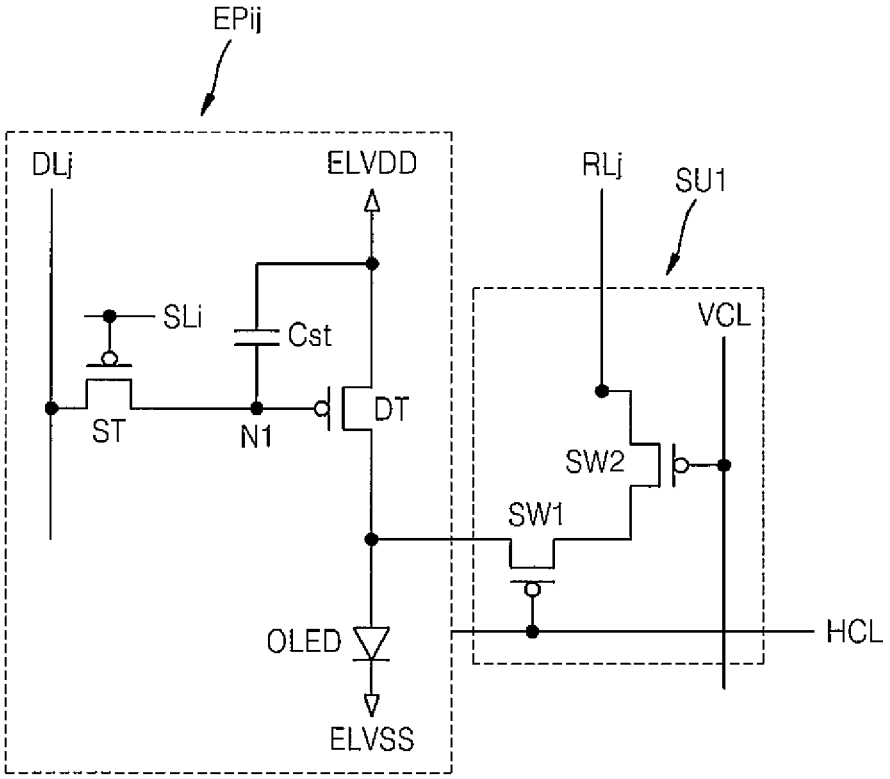
FIG. 6 is a circuit diagram of a light-emitting pixel of FIG. 4 according to an embodiment of the present invention.

FIG. 4 is a plan view illustrating a portion of a display panel according to an embodiment of the present invention. FIG. 5 is a circuit diagram of a dummy pixel DPj of FIG. 4 according to an embodiment of the present invention. FIG. 6 is a circuit diagram of a light-emitting pixel EPij of FIG. 4 according to an embodiment of the present invention.

FIGS. 4 through 6 illustrate a light-emitting pixel EPij coupled in a j-th column and an i-th row and a dummy pixel DPj coupled in the j-th column and a dummy row (a 0-th row or an (n+1)th row).

The dummy pixel DPj includes a dummy pixel circuit DPC and does not include a light-emitting device. However, the embodiments of the present invention are not limited thereto, and the dummy pixel DPj may include a dummy light-emitting device, and in this case, the dummy light-emitting device may not emit light but may function as a circuit element. For example, the dummy light-emitting device may function as a capacitor. The dummy pixel circuit DPC of the dummy pixel DP may be the same as or different from the pixel circuit PC of the light-emitting pixel EP.

The dummy pixel circuit DPC may include a dummy switching transistor DST coupled to a dummy scanning line DSL and a data line DLj, a dummy driving transistor DDT coupled between a first power voltage ELVDD and the dummy switching transistor DST, and a dummy capacitor DCst coupled between the first power voltage ELVDD and the dummy driving transistor DDT. FIG. 4 illustrates an example dummy pixel circuit DPC, and the dummy pixel circuit DPC is not limited thereto but may have various configurations. For example, the dummy pixel circuit DPC may include at least one TFT and at least one capacitor, or may not include a capacitor. The dummy driving transistor DDT is coupled to a repair line RLj.

The light-emitting pixel EPij includes a light-emitting device ED and a pixel circuit PC, through which a current is supplied to the light-emitting device ED. The light-emitting device ED may be an organic light-emitting diode OLED including a first electrode, a second electrode facing the first electrode, and an emission layer between the first and second electrodes. The first electrode and the second electrode may be an anode electrode (e.g., pixel electrode) and a cathode electrode (e.g., opposite electrode), respectively. The pixel circuit PC may include two transistors (a switching transistor ST and a driving transistor DT) and one capacitor Cst.

A gate electrode of the switching transistor ST is coupled to a scanning line SLi, and a first electrode thereof is coupled to a data line DLj, and a second electrode thereof is coupled to a first node N1.

A gate electrode of the driving transistor DT is coupled to the first node N1, and a first electrode thereof receives a first power voltage ELVDD through a first power voltage line, and a second electrode thereof is coupled to the anode electrode of the light-emitting device ED.

A first electrode of the capacitor Cst is coupled to the first node N1, and a second electrode of the capacitor Cst receives a first power voltage ELVDD through the first power voltage line.

When a scanning signal is supplied through the scanning line SLi, the switching transistor ST transmits a data signal supplied through the data line DLj to the first electrode of the capacitor Cst. Accordingly, a voltage corresponding to the data signal is charged in the capacitor Cst. The driving transistor DT outputs a driving current according to a voltage between the gate electrode and the first electrode thereof, and the light-emitting device ED emits light.

A switching unit SU1 coupled to the repair line RLj may be coupled to the light-emitting pixel EPij. The switching unit SU1 may include a first repair switching device SW1 and a second repair switching device SW2 that are serially connected.

The first repair switching device SW1 may be coupled to the light-emitting device ED. For example, the first repair switching device SW1 may be coupled to a wiring to which the pixel circuit PC and the light-emitting device ED are coupled and may be turned on or off by receiving a control signal through a horizontal control line HCL. A gate electrode of the first repair switching device SW1 is coupled to the horizontal control line HCL, a first electrode of the first repair switching device SW1 is coupled to the second repair switching device SW2, and a second electrode of the first repair switching device SW1 is coupled to the light-emitting device ED. The first repair switching device SW1 may be turned off via a first control signal which is at a high level (e.g., a higher voltage or a logic high) and may be turned on via a second control signal which is at a low level (e.g., a lower voltage or a logic low), applied through the horizontal control line HCL.

The second repair switching device SW2 may be coupled to the repair line RLj and may be turned on or off by receiving a control signal through a vertical control line VCL. A gate electrode of the second repair switching device SW2 is coupled to the vertical control line VCL, a first electrode of the second repair switching device SW2 is coupled to the repair line RLj, and a second electrode of the second repair switching device SW2 is coupled to the first repair switching device SW1. The second repair switching device SW2 may be turned off via a first control signal which is at a high level and may be turned off via a second control signal which is at a low level, applied through the vertical control line VCL.

The horizontal control line HCL and the vertical control line VCL extend up to an outer portion of the display area AA. The horizontal control line HCL and the vertical control line VCL may be coupled to a first control voltage line or a second control voltage line in a non-display area NA which is in the outer portion of the display area AA.

Although a pixel including a pixel circuit, in which two transistors and one capacitor are included, is illustrated in FIG. 6, embodiments of the present invention are not limited thereto, and a pixel may have various configurations. For example, two or more transistors and one or more capacitors may be included in a single pixel, and wirings may be additionally formed or existing wirings may be omitted.

Figure 7:
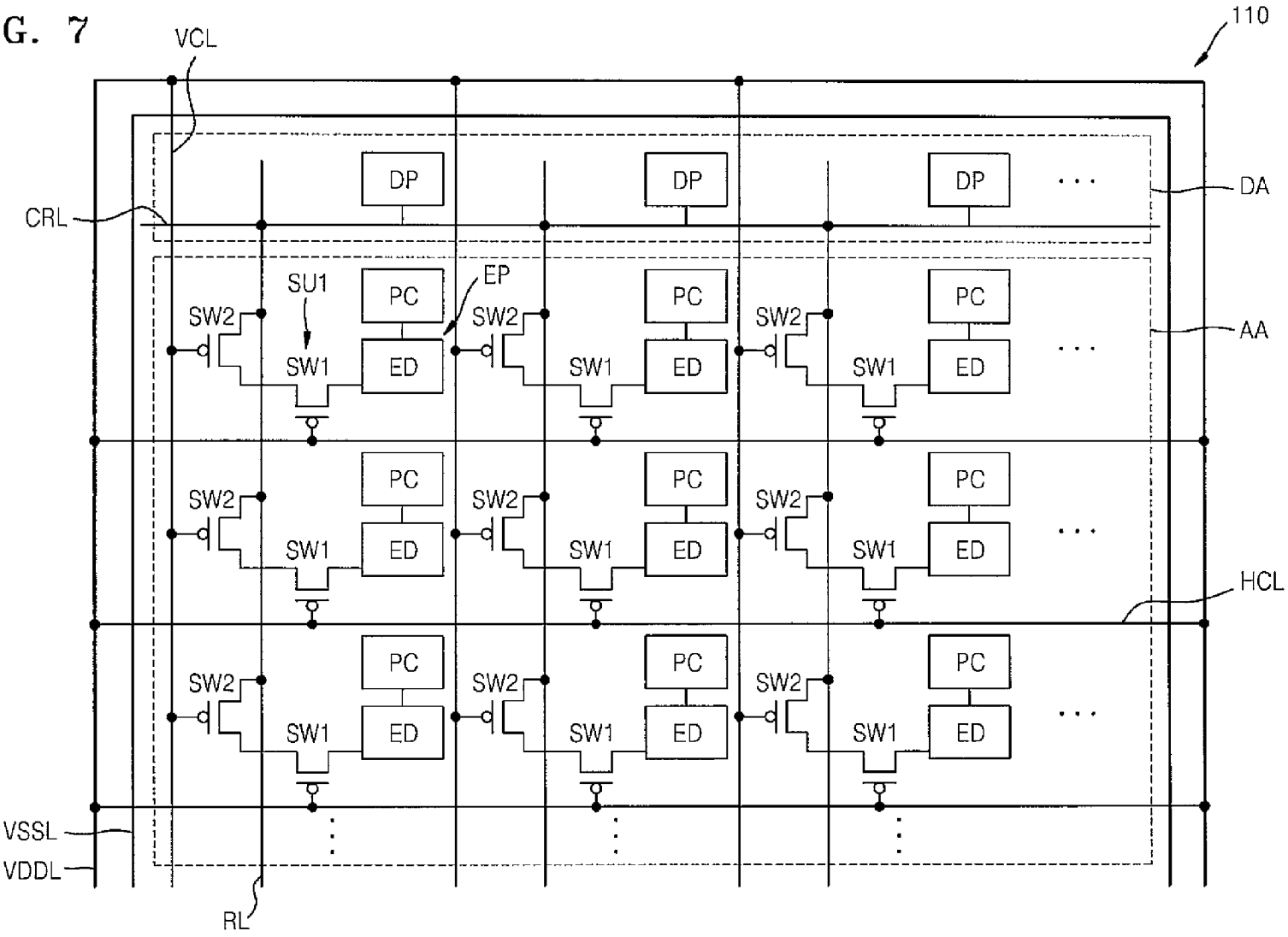
FIGS. 7 and 8 illustrate a method of repairing a defective pixel in a display panel, according to an embodiment of the present invention.
Figure 8:
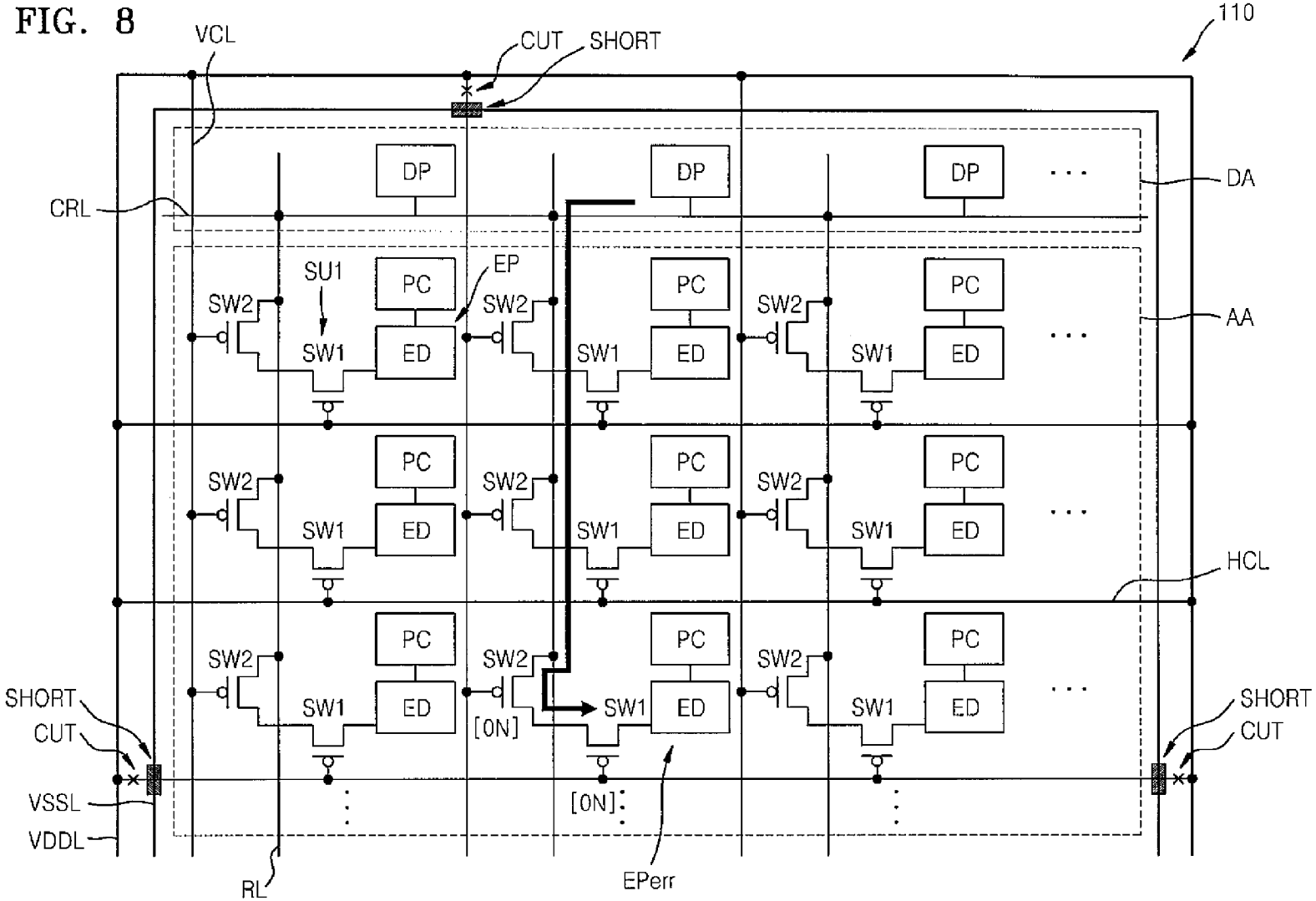

FIGS. 7 and 8 illustrate a method of repairing a defective pixel in the display panel 110, according to an embodiment of the present invention.

Referring to FIG. 7, a first driving voltage line VDDL may be provided as a first control voltage line and a second driving voltage line VSSL may be provided as a second control voltage line along an outer portion of a display area AA. The first driving voltage line VDDL and the second driving voltage line VSSL may be arranged in a non-display area, which is an area other than an area where driving units of the display panel 110 are located. For example, the first driving voltage line VDDL and the second driving voltage line VSSL may be arranged on three planes of the display panel 110 in the non-display area. The second driving voltage line VSSL may be arranged adjacent to the display area AA, and the first driving voltage line VDDL may be separate from the first driving voltage line VDDL (e.g., first driving voltage line VDDL may be a distance away from the second driving voltage line VSSL), in an outer portion of the second driving voltage line VSSL.

Dummy pixels DP are located in a dummy area DA, and light-emitting pixels EP, each including a pixel circuit PC and a light-emitting device ED, are located in the display area AA. A switching unit SU1 is coupled to each light-emitting pixel EP. Dummy pixels DP located in respective columns in a row direction are coupled to a common repair line CRL, and a plurality of repair lines RL extending in a column direction are coupled to the common repair line CRL. For convenience of description, a dummy scanning line and a data line coupled to the dummy pixel DP, and a scanning line and a data line coupled to the light-emitting pixel EP are omitted in FIG. 7.

A horizontal control line HCL is arranged in each row and a vertical control line VCL is arranged in each column in the display panel 110.

The horizontal control line HCL and the vertical control line VCL are coupled to the first driving voltage line VDDL arranged in the non-display area in an outer portion of the display area AA. The horizontal control line HCL and the vertical control line VCL may be separated from the first driving voltage line VDDL in a separation area. Here, the "separation area" refers to an area where laser or the like is irradiated in order to separate coupled members in a repair process. For example, the separation area according to an embodiment of the present invention may be a portion of an area where the horizontal control line HCL and the vertical control line VCL are each coupled to the first driving voltage line VDDL in the outer portion of the display area AA.

Also, the horizontal control line HCL and the vertical control line VCL may be connectable to the second driving voltage line VSSL. Here, the term "connectable" refers that although predetermined lines are initially not coupled (e.g., during the manufacturing process), they may be coupled during a repair process by laser irradiation or the like. For example, the horizontal control line HCL and the second driving voltage line VSSL, and the vertical control line VCL and the second driving voltage line VSSL, which are respectively connectable to each other, may partially overlap each other with an insulation layer therebetween in an overlapping area. When laser is irradiated at the overlapping area during a repair process, the insulation layer in the overlapping area may be destroyed and the horizontal control line HCL and the second driving voltage line VSSL, and the vertical control line VCL and the second driving voltage line VSSL may become electrically coupled to each other, respectively. For example, the "overlapping area" according to the current embodiment of the present invention may be a portion of areas where the horizontal control line HCL and the vertical control line VCL each overlap the second driving voltage line VSSL in the outer portion of the display area AA.

That is, the term "connectable" in the present specification means that although a plurality of members are not initially coupled during a manufacturing process, they are coupled via a connection member (for example, switching unit) or by direct irradiation of laser or the like.

The first repair switching device SW1 and the second repair switching device SW2 of the switching unit SU1 receive a first driving voltage VDD, which is at a high level and is applied through the first driving voltage line VDDL, respectively through the horizontal control line HCL and the vertical control line VCL to maintain an off state. Accordingly, each light-emitting pixel EP is electrically blocked from a corresponding repair line RL.

Referring to FIG. 8, when a defective pixel EPerr is detected from among light-emitting pixels EP, the defective pixel EPerr is electrically coupled to the repair line RL.

According to an embodiment, in the outer portion of the display area AA, laser is irradiated to the left and right separation areas of the horizontal control line HCL of the row corresponding to the defective pixel EPerr, to thereby cut (or separate) the horizontal control line HCL from the first driving voltage line VDDL. Also, in the outer portion of the display area AA, laser is irradiated to an overlapping area between at least one of left and right ends of the separated horizontal control line HCL and the second driving voltage line VSSL to short (e.g., electrically couple to each other) the horizontal control line HCL and the second driving voltage line VSSL, thereby electrically coupling the horizontal control line HCL to the second driving voltage line VSSL. As the insulation layer between the second driving voltage line VSSL and the horizontal control line HCL is destroyed, the second driving voltage line VSSL and the horizontal control line HCL may become electrically coupled.

Also, in the outer portion of the display area AA, laser is irradiated to a separation area of the vertical control line VCL of the column corresponding to the defective pixel EPerr, to thereby cut the vertical control line VCL from the first driving voltage line VDDL. Also, in the outer portion of the display area AA, laser is irradiated to an overlapping area between the separated vertical control line VCL and the second driving voltage line VSSL to short the vertical control line VCL and the second driving voltage line VSSL, thereby electrically coupling the vertical control line VCL to the second driving voltage line VSSL. As the insulation layer between the second driving voltage line VSSL and the vertical control line VCL is destroyed, the second driving voltage line VSSL and the vertical control line VCL may become electrically coupled to each other.

Accordingly, the first repair switching device SW1 and the second repair switching device SW2 of the switching unit SU1 may maintain a turned-on state due to the second driving voltage VSS which is at a low level and is applied to the second driving voltage line VSSL. Accordingly, an electrical path is formed between the first repair switching device SW1 and the second repair switching device SW2, and a current path from the dummy pixel DP coupled to the repair line RL to the light-emitting device ED of the defective pixel EPerr may be formed via the second repair switching device SW2 and the first repair switching device SW1.

That is, according to an embodiment of the present invention, laser is not directly irradiated to the display area AA but to the outer portion of the display area AA to electrically couple the dummy pixel DP and the defective pixel EPerr. Thus, the defective pixel EPerr may be repaired while preventing damage to an encapsulation member and the light-emitting device of the display area AA.

Figure 9:
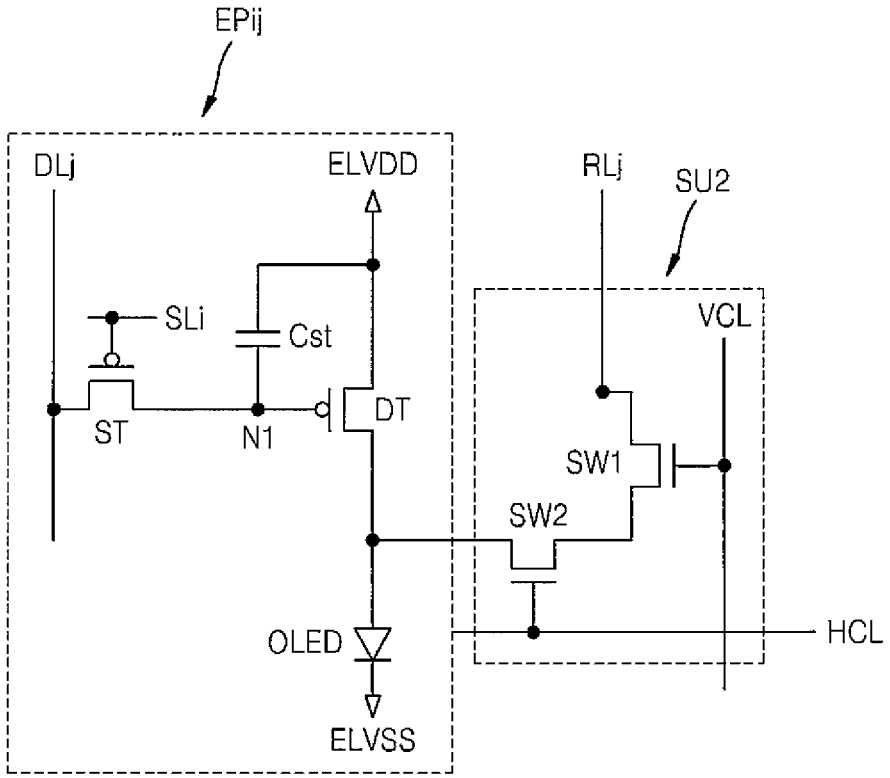
FIG. 9 is a circuit diagram of a switching unit according to another embodiment of the present invention.

FIG. 9 is a circuit diagram of a switching unit SU2 according to another embodiment of the present invention.

While the first repair switching device SW1 and the second repair switching device SW2 of the switching unit SU1 illustrated in FIG. 6 are P-type transistors, a first repair switching device SW1 and a second repair switching device SW2 of the switching unit SU2 illustrated in FIG. 9 are N-type transistors. A light-emitting pixel EPij illustrated in FIG. 9 is the same as the light-emitting pixel EPij illustrated in FIG. 6, and thus detailed description thereof will be omitted.

The first repair switching device SW1 may be turned on via a first control signal which is at a high level and may be turned off via a second control signal which is at a low level, applied through the horizontal control line HCL. The second repair switching device SW2 may be turned on via a first control signal which is at a high level and a second control signal which is at a low level, applied through the vertical control line VCL.

In addition, connection between the first repair switching device SW1 and the second repair switching device SW2 is substantially the same as illustrated in FIG. 6, and thus detailed description thereof will be omitted.

Figure 10:
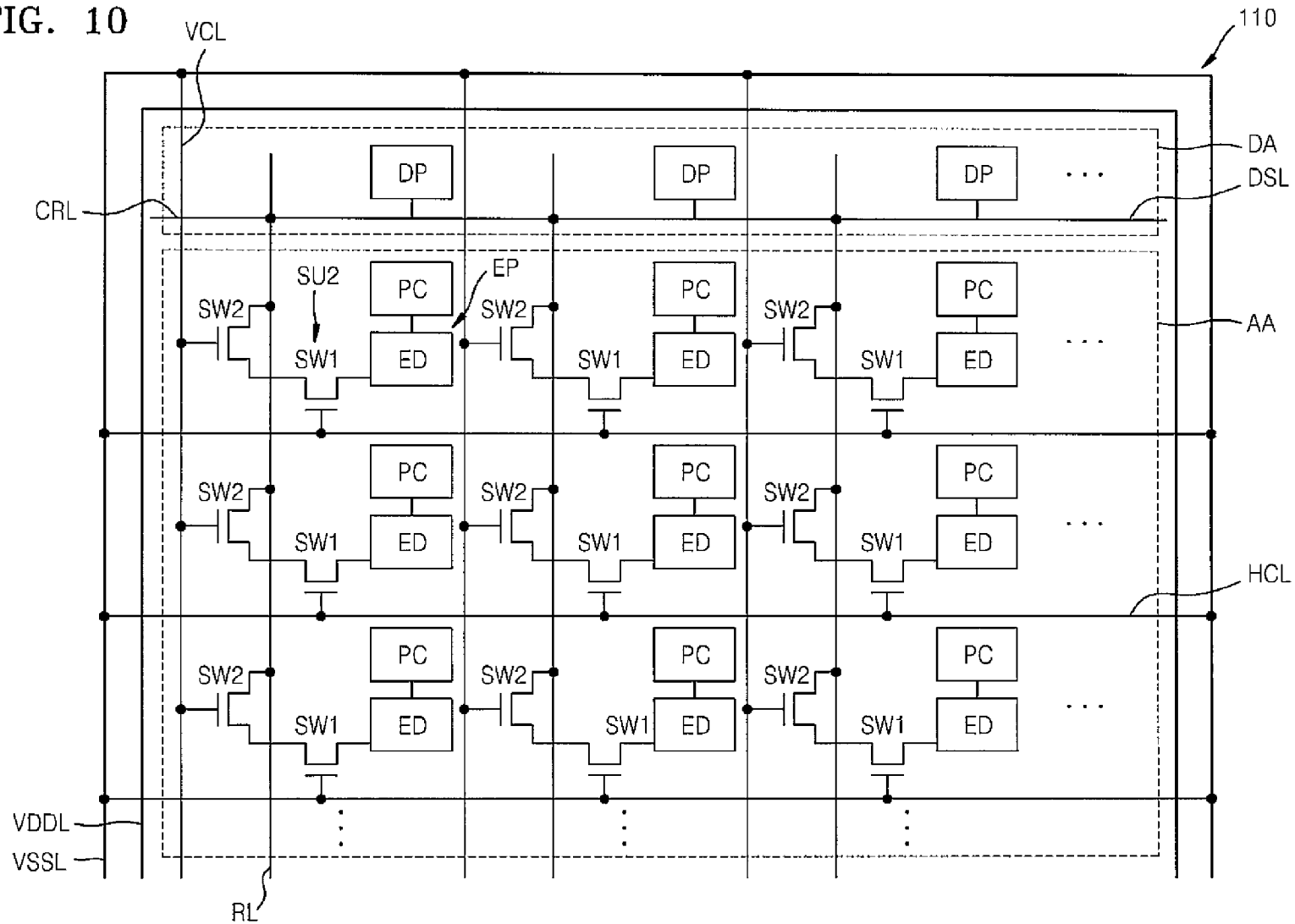
FIGS. 10 and 11 illustrate a method of repairing a defective pixel in a display panel, according to another embodiment of the present invention.
Figure 11:
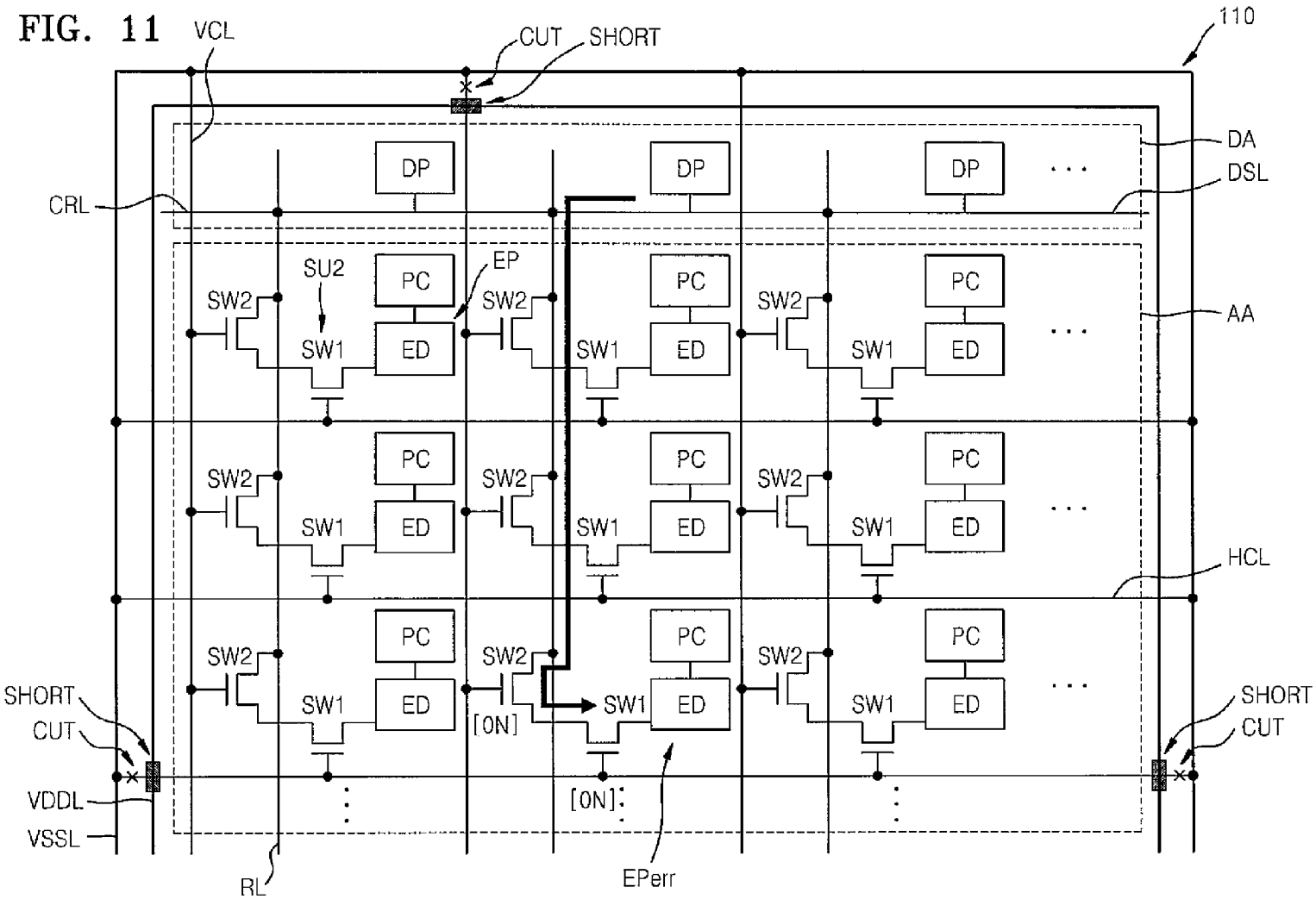

FIGS. 10 and 11 illustrate a method of repairing a defective pixel in the display panel 110, according to another embodiment of the present invention.

Referring to FIG. 10, a first driving voltage line VDDL as a first control voltage line and a second driving voltage line VSSL as a second control voltage line may be arranged in an outer portion of the display area AA. The first driving voltage line VDDL and the second driving voltage line VSSL may be in a non-display area, which is an area other than an area where driving units of the display panel 110 are located. For example, the first driving voltage line VDDL and the second driving voltage line VSSL may be arranged on three planes of the display panel 110 in a non-display area. The first driving voltage line VDDL may be adjacent to the display area AA, and the second driving voltage line VSSL may be separate from the first driving voltage line VDDL and in an outer portion of the first driving voltage line VDDL.

In a dummy area DA, dummy pixels DP are provided, and light-emitting pixels EP, each including a pixel circuit PC and a light-emitting device ED, are located in the display area AA. A switching unit SU2 is coupled to the light-emitting pixel EP. Dummy pixels DP arranged in the row direction are coupled to a common repair line CRL, and a plurality of repair lines RL coupled to the common repair line CRL are arranged in a column direction. For convenience of description, a dummy scanning line and a data line coupled to the dummy pixel DP, and a scanning line and a data line coupled to the light-emitting pixel EP are omitted in FIG. 10.

A horizontal control line HCL is arranged in each row and a vertical control line VCL is arranged in each column in the display area AA.

The horizontal control line HCL and the vertical control line VCL are coupled to the second driving voltage line VSSL in the non-display area in an outer portion of the display area AA. The horizontal control line HCL and the vertical control line VCL may be separated from the second driving voltage line VSSL in a separation area. For example, according to an embodiment of the present invention, the separation area may be a portion of an area where the horizontal control line HCL and the vertical control line VCL are each coupled to the second driving voltage line VSSL in the outer portion of the display area AA.

Also, the horizontal control line HCL and the vertical control line VCL may be connectable to the first driving voltage line VDDL. For example, according to the current embodiment of the present invention, the horizontal control line HCL and the first driving voltage line VDDL, and the vertical control line VCL and the first driving voltage line VDDL may be arranged such that portions thereof overlap at an overlapping area with an insulation layer therebetween, and when laser is irradiated to the overlapping area, the insulation layer in the overlapping area may be destroyed so that the horizontal control line HCL and the first driving voltage line VDDL, and the vertical control line VCL and the first driving voltage line VDDL may be electrically coupled, respectively.

The first repair switching device SW1 and the second repair switching device SW2 of the switching unit SU2 receive a second driving voltage VSS which is at a low level and is applied through the second driving voltage line VSSL respectively through the horizontal control line HCL and the vertical control line VCL to maintain an off state. Accordingly, each light-emitting pixel EP is electrically blocked from a corresponding repair line RL.

Referring to FIG. 11, when a defective pixel EPerr is detected from among light-emitting pixels EP, the defective pixel EPerr is coupled to a repair line RL.

For example, in an outer portion of the display area AA, laser is irradiated to left and right separation areas of the horizontal control line HCL of the row, in which the defective pixel EPerr is arranged, to thereby cut (e.g., electrically open) the horizontal control line HCL from the second driving voltage line VSSL. Also, in the outer portion of the display area AA, laser is irradiated to an overlapping area between at least one of left and right ends of the separated horizontal control line HCL and the first driving voltage line VDDL to short (e.g., electrically couple to each other) the horizontal control line HCL and the first driving voltage line VDDL, thereby electrically coupling the horizontal control line HCL to the first driving voltage line VDDL. As the insulation layer between the first driving voltage line VDDL and the horizontal control line HCL is destroyed, the first driving voltage line VDDL and the horizontal control line HCL may become electrically coupled.

Also, in the outer portion of the display area AA, laser is irradiated to a separation area of the vertical control line VCL of the column corresponding to the defective pixel EPerr, to thereby cut the vertical control line VCL from the second driving voltage line VSSL. Also, in the outer portion of the display area AA, laser is irradiated to an overlapping area between the separated vertical control line VCL and the first driving voltage line VDDL to short (e.g., electrically couple to each other) the vertical control line VCL and the first driving voltage line VDDL, thereby electrically coupling the vertical control line VCL to the first driving voltage line VDDL. As the insulation layer between the first driving voltage line VDDL and the vertical control line VCL is destroyed, the first driving voltage line VDDL and the vertical control line VCL may become electrically coupled to each other.

Accordingly, the first repair switching device SW1 and the second repair switching device SW2 of the switching unit SU2 may maintain an on state due to the first driving voltage VDD which is at a high level and is applied to the first driving voltage VDDL. Accordingly, electricity flows between the first repair switching device SW1 and the second repair switching device SW2, and a current path from the dummy pixel DP coupled to the repair line RL to the light-emitting device ED of the defective pixel EPerr may be formed via the second repair switching device SW2 and the first repair switching device SW1.

That is, according to an embodiment of the present invention, laser is not directly irradiated to the display area AA but to the outer portion of the display area AA to electrically couple the dummy pixel DP and the defective pixel EPerr. Thus, the defective pixel EPerr may be repaired while preventing damage to an encapsulation member and the light-emitting device of the display area AA.

As described above, according to the flexible display apparatus of one or more of the above embodiments of the present invention, defective pixels may be repaired without directly irradiating laser to a display area but by irradiating laser to an outer portion of the display area by using a dummy pixel.

It should be understood that the example embodiments described therein should be considered in a descriptive sense only and not for purposes of limitation. Descriptions of features or aspects within each embodiment should typically be considered as available for other similar features or aspects in other embodiments.

While one or more embodiments of the present invention have been described with reference to the figures, it will be understood by those of ordinary skill in the art that various changes in form and details may be made therein without departing from the spirit and scope of the present invention as defined by the following claims and their equivalents.

What is claimed is:

1. A flexible display apparatus comprising: a light-emitting pixel comprising a driving unit configured to output a driving current corresponding to a data signal and a light-emitting device configured to emit light according to the driving current;

a repair line connectable to the light-emitting pixel;

a first control line extending in a first direction and a second control line extending in a second direction;

a switching unit that is coupled to the first control line and the second control line and configured to control a connection between the repair line and the light-emitting pixel according to a first control signal applied through the first control line and a second control signal applied through the second control line; and a dummy pixel coupled to the repair line, and coupled to the light-emitting pixel via the switching unit.

2. The flexible display apparatus of claim 1, wherein the switching unit comprises:

a first repair switching device coupled to the light-emitting pixel, and configured to be turned on or off by the first control signal; and a second repair switching device serially coupled to the first repair switching device, and coupled to the repair line, and configured to be turned on or off by the second control signal.

3. The flexible display apparatus of claim 2, wherein the first repair switching device is coupled to the light-emitting device of the light-emitting pixel.

4. The flexible display apparatus of claim 2, further comprising:

a first control voltage line outside of a display area of the flexible display apparatus, and coupled to the first and second control lines; and a second control voltage line separate from the first control voltage line, and connectable to the first and second control lines.

5. The flexible display apparatus of claim 4, wherein the first control voltage line is configured to apply the first control signal to the first control line and the second control line, and the switching unit is configured to block an electrical connection between the repair line and the light-emitting pixel via the first control signal.

6. The flexible display apparatus of claim 4, wherein at the outside of the display area, the first control voltage line is separated from the first control line and the second control line, and the second control voltage line is coupled to the first control line and the second control line.

7. The flexible display apparatus of claim 6, wherein the second control voltage line is configured to apply the second control signal to the first control line and the second control line, and the switching unit is configured to couple the repair line and the light-emitting pixel via the second control signal.

8. The flexible display apparatus of claim 2, wherein the first repair switching device and the second repair switching device comprise thin film transistors.

9. The flexible display apparatus of claim 1, further comprising:

a data driver configured to apply the data signal to a data line;

a scanning driver configured to apply a scanning signal to a scanning line; and a power supply unit configured to generate a first driving voltage and a second driving voltage, the second driving voltage being lower than the first driving voltage, the power supply unit being further configured to apply the first and second driving voltages to the data driver and the scanning driver, wherein the first control signal is the first driving voltage or the second driving voltage, and wherein the second control signal is the first driving voltage or the second driving voltage.

10. The flexible display apparatus of claim 1, further comprising:

a flexible substrate on which the light-emitting pixel and the dummy pixel are located; and an encapsulation thin film covering the light-emitting pixel and the dummy pixel.

11. A flexible display apparatus comprising:

a plurality of light-emitting pixels in a display area;

a plurality of dummy pixels located around the display area;

a plurality of repair lines coupled to the plurality of dummy pixels and connectable to the plurality of light-emitting pixels;

a plurality of first control lines configured to apply a first control signal and a plurality of second control lines configured to apply a second control signal; and a plurality of switching units, each coupled to a corresponding first control line from among the plurality of first control lines, a corresponding second control line from among the plurality of second control lines, and a corresponding light-emitting pixel from among the plurality of light-emitting pixels.

12. The flexible display apparatus of claim 11, wherein each of the plurality of switching units comprises:

a first repair switching device coupled to the corresponding light-emitting pixel and configured to be turned on or off by the first control signal received from the corresponding first control line; and a second repair switching device serially coupled to the first repair switching device, and coupled to a corresponding repair line from among the plurality of repair lines, and configured to be turned on or off by the second control signal received from the corresponding second control line.

13. The flexible display apparatus of claim 12, wherein the first repair switching device is coupled to a light-emitting device of the corresponding light-emitting pixel from among the plurality of light-emitting pixels.

14. The flexible display apparatus of claim 11, further comprising:

a first control voltage line located outside of the display area and coupled to the plurality of first and second control lines; and a second control voltage line separate from the first control voltage line and located outside of the display area and connectable to the first and second control lines.

15. The flexible display apparatus of claim 14, wherein the first control voltage line is configured to apply the first control signal to the first control line and the second control line, and each of the plurality of switching units is configured to block a connection between a corresponding repair line from among the plurality of repair lines and the corresponding light-emitting pixel.

16. The flexible display apparatus of claim 14, wherein at the outside of the display area, at least one of the plurality of first control lines and at least one of the plurality of second control lines are separated from the first control voltage line and coupled to the second control voltage line.

17. The flexible display apparatus of claim 16, wherein the second control voltage line is configured to apply the second control signal to the first control line and the second control line, and a switching unit from among the plurality of switching units which is coupled to the first control line and the second control line, through which the second control signal is applied, the switching unit configured to couple a corresponding repair line from among the plurality of repair lines and the corresponding light-emitting pixel.

18. A method of repairing a flexible display apparatus comprising a plurality of light-emitting pixels and a plurality of dummy pixels, a plurality of repair lines coupled to the plurality of dummy pixels, a plurality of first control lines and a plurality of second control lines coupled to a first control voltage line arranged outside of a display area, and a plurality of switching units coupled to the plurality of first control lines and the plurality of second control lines, the method comprising:

detecting a defective pixel from among the plurality of light-emitting pixels;

separating a first control line of the plurality of first control lines and a second control line of the plurality of second control lines coupled to a switching unit of the plurality of switching unit corresponding to the defective pixel, from the first control voltage line, at the outside of the display area; and electrically coupling the first control line and the second control line separated from the first control voltage line, to a second control voltage line separate from the first control voltage line, at the outside of the display area.

19. The method of claim 18, wherein each of the plurality of switching units comprises:

a first repair switching device coupled to one of the plurality of light-emitting pixels and one of the plurality of first control lines; and a second repair switching device coupled to one of the plurality of repair lines and one of the plurality of second control lines.

20. The method of claim 19, wherein the switching unit of the defective pixel receives a second control signal from the second control voltage line through the first control line and the second control line to couple the defective pixel to a dummy pixel of the plurality of dummy pixels via a repair line of the plurality of repair lines, and wherein each of the plurality of switching units of the light-emitting pixels other than the defective pixel receives a first control signal from the first control voltage line through the first control lines and the second control lines to block connection between a corresponding light-emitting pixel from among the plurality of light-emitting pixels and the repair line.

* * * * *